US010519692B1

(12) United States Patent
Baird et al.

(10) Patent No.: US 10,519,692 B1
(45) Date of Patent: Dec. 31, 2019

(54) DOOR LATCH

(71) Applicants: Alexander J. Baird, Concord, NC (US); Adam D. Baird, Salisbury, NC (US)

(72) Inventors: Alexander J. Baird, Concord, NC (US); Adam D. Baird, Salisbury, NC (US)

(73) Assignee: KONTEK INDUSTRIES, INC., Kannapolis, NC (US)

( * ) Notice: Subject to any disclaimer, the term of this patent is extended or adjusted under 35 U.S.C. 154(b) by 63 days.

(21) Appl. No.: 15/593,972

(22) Filed: May 12, 2017

(51) Int. Cl.

| | |
|---|---|
| ***E05B 15/10*** | (2006.01) |
| ***E05C 1/12*** | (2006.01) |
| ***E05B 55/12*** | (2006.01) |
| ***E05B 17/20*** | (2006.01) |
| ***E05B 15/00*** | (2006.01) |
| ***E05B 63/16*** | (2006.01) |

(52) U.S. Cl.
CPC ..... *E05B 15/10* (2013.01); *E05B 15/004* (2013.01); *E05B 17/2007* (2013.01); *E05B 17/2069* (2013.01); *E05B 55/12* (2013.01); *E05B 63/16* (2013.01); *E05C 1/12* (2013.01)

(58) Field of Classification Search
CPC ..... E05B 9/00; E05B 9/02; E05B 15/0013; E05B 15/004; E05B 15/10; E05B 15/102; E05B 2015/105; E05B 17/20; E05B 17/2007; E05B 17/203; E05B 17/2038; E05B 17/2069; E05B 33/00; E05B 55/00; E05B 63/16; Y10T 292/096; Y10T 292/1014; Y10S 292/63
See application file for complete search history.

(56) References Cited

U.S. PATENT DOCUMENTS

| | | | | | |
|---|---|---|---|---|---|
| 49,297 | A * | 8/1865 | Post | E05B 55/00 | 70/150 |
| 55,814 | A * | 6/1866 | Budd et al. | E05B 55/00 | 70/156 |
| 233,711 | A * | 10/1880 | Spencer et al. | E05C 1/14 | 292/173 |
| 283,268 | A * | 8/1883 | Mix et al. | E05B 55/00 | 292/169.17 |
| 372,963 | A * | 11/1887 | Budd et al. | E05B 55/00 | 70/150 |
| 514,511 | A * | 2/1894 | Sorensen | E05B 17/20 | 292/8 |

(Continued)

*Primary Examiner* — Christopher J Boswell
(74) *Attorney, Agent, or Firm* — Barclay J. Tullis

(57) ABSTRACT

A lockable spring-biased latchbolt in some embodiments of a door latch is manipulatable from a first side (protected side) of a door by translation to an opened-door position, and a separate element situated alongside the latchbolt is manipulatable from a second side (less protected side) of the door to contact and move the latchbolt to the opened-door position only if movement of that second element is not prevented by a locked position of a locking means. The locking means in these embodiments does not interfere with opening the door from the first side. The locking means can be changed back and forth between its locked position and its unlocked position by use of a key (or combination or code) from the second side of the door, and optionally from the first side of the door with or without the key (or combination or code).

20 Claims, 9 Drawing Sheets

(56) References Cited

U.S. PATENT DOCUMENTS 640,217 A * 1/1900 Moore ..... E05B 55/00 70/153
697,599 A * 4/1902 Barrett ..... E05B 55/00 70/150
790,206 A * 5/1905 Hintz ..... E05B 55/00 70/150
840,225 A * 1/1907 Marbach ..... E05B 15/10 292/169.21
975,880 A * 11/1910 Markovitz ..... E05B 55/00 70/150
1,064,800 A * 6/1913 Whitcomb ..... E05B 85/22 292/173
2,036,154 A * 3/1936 Littledale ..... E05C 1/14 292/170
2,098,569 A * 11/1937 Curtis ..... E05C 1/04 292/150
3,999,789 A 12/1976 Maurits et al.
4,073,172 A 2/1978 Schlage
4,446,707 A 5/1984 Mullich et al.
4,565,079 A 1/1986 Smith
4,876,866 A 10/1989 Fleming et al.
5,259,652 A * 11/1993 Adams ..... E05B 13/002 292/169.14
5,524,944 A * 6/1996 Berg ..... E05B 67/383 292/148
5,657,653 A 8/1997 Hensley et al.
6,128,933 A 10/2000 Mirshafiee et al.
6,217,088 B1 * 4/2001 Magnusson ..... E05B 15/0013 292/165
7,377,558 B2 * 5/2008 Schimmler ..... E05B 13/005 292/137
8,434,335 B2 5/2013 Roth et al.
8,491,023 B2 7/2013 Brannaman et al.
8,864,186 B2 * 10/2014 Kondratuk ..... E05B 55/00 292/165
9,223,355 B2 * 12/2015 Kim ..... G06F 1/1679
9,394,732 B1 * 7/2016 Ahmad ..... E05C 1/08
2006/0255596 A1 * 11/2006 Yong ..... E05C 1/14 292/173
2011/0277517 A1 * 11/2011 Aschieri ..... E05B 13/004 70/91

* cited by examiner

DOOR LATCH

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to lockable spring-return door latches for doors that swing open and closed.

Description of the Related Art

Spring-return latchbolts are well known in the arts and commonly used for door closures, and tubular latchbolts are the preferred design for use in homes where they are each installed within a hole bored into a door through its vertical edge on the opposite side of the door from the door hinges. Latchbolts have a beveled end that is pushed temporarily into the door when that end strikes a strike-plate mounted on the door jam as the door closes; this permits the door to be closed without having to manually move the latchbolt into the door to clear the strike-plate upon door closings. Tubular deadbolts are also commonly used with doors to provide greater security. Deadbolts have an end that is not beveled as a latchbolt and are not spring-return operated; each has to be manually moved into a door jam after the door closes and again before the door opens. The extra security provided by a deadbolt comes from its not being able to be pushed back into the door, whereas latchbolts can often be pushed back (i.e. opened) by use of a card slipped between the door and the door jam. Both tubular latchbolts and tubular deadbolts are designed to integrate easily with spindles extended from rotatable door knobs or other rotatable handles. And door knobs and other rotatable handles are readily available with added tumbler key locks inside. Combinations of latchbolts, deadbolts, knobs, and rotatable handles make up the moving parts of complete door lock sets. These devices are all well known in the art as exemplified by disclosures in U.S. patents having the following numbers: U.S. Pat. No. 3,999,789 by Maurits et al., U.S. Pat. No. 4,073,172 by Schlage, U.S. Pat. No. 4,446,707 by Mullich et al., U.S. Pat. No. 4,565,079 by Smith, U.S. Pat. No. 4,876,866 by Fleming et al., U.S. Pat. No. 5,657,653 by Hensley et al., U.S. Pat. No. 6,128,933 by Mirshafiee et al., U.S. Pat. No. 8,434,335 by Roth et al., and U.S. Pat. No. 8,491,023 by Brannaman et al.

These patent disclosures are all incorporated in their entireties within this present disclosure.

BRIEF SUMMARY OF THE INVENTION

The invention is pointed out with particularity in the appended claims. However, some aspects of the invention are summarized in the following descriptions of some embodiments (i.e. implementation examples) and aspects.

Some embodiments of the invention provide a lockable spring-biased latchbolt manipulated from a first side (protected side) of a door by translation to an opened-door position, and a separate element (defined in the present disclosure to be a second movement means) situated alongside the latchbolt and manipulated from a second side (less protected side) of the door to contact and move the latchbolt to the opened-door position only if movement of that separate element (i.e. the second movement means) is not prevented by a locked position of a locking means. The locking means in these embodiments does not interfere with opening the door from the first side. The locking means can be changed back and forth between its locked position and its unlocked position by use of a key (or combination or code) from the second side of the door, and optionally from the first side of the door with or without the key (or combination or code). Alternative embodiments involve different geometries of the latchbolt, the separate element (i.e. the second movement means), and the locking means, as well as their means of manipulation. Different latchbolt embodiments can be applied to different door and door casement (or wall) configurations.

Some embodiments of the invention provide door-latch mechanisms each comprising: a) a spring-biased latchbolt, b) a separate element that is separate from the latchbolt and situated alongside the latchbolt, c) a locking means, and d) a structural element that supports the latchbolt, the separate element, and the locking means; wherein the latchbolt is manipulatable from a first side of a door by translation from a closed-door position to an opened-door position without disturbing the separate element; wherein the locking means, whether locked or unlocked, cannot prevent opening of the door from the first side; and wherein the separate element is manipulatable from a second side of the door to maintain contact with the latchbolt and to move the latchbolt from the closed-door position to the opened-door position only when the locking means is not locked. The locking means in some of these embodiments are lockable and unlockable from the second side of the door by use of a physical or electronic key. In some embodiments, the locking means can be lockable and unlockable from the first side of the door without the use of a physical or electronic key. Some embodiments include at least one spring that biases the latchbolt toward the closed-door position. Some embodiments include a respective handle or knob to manipulate each of the latchbolt and the separate element. In some embodiments, the latchbolt includes an extension for contact with the separate element. In some embodiments, the separate element includes a surface or edge that contacts a dog extended from the locking means when the locking means is in a locked position. In some embodiments, the separate element translates parallel to the latchbolt, but in others it rotates. In some embodiments in which the separate element is controlled by a rotation, the separate element can be cam-driven or can itself be a cam. In some embodiments in which movement of the separate element is controlled by rotation, a lock device can be incorporated within the control element (e.g. within a knob controlling the separate element), and/or the separate elements can each rotate and be drivable by a key-lock mechanism.

Some embodiments of the invention provide door-latch mechanisms each comprising: a) a latchbolt, b) a latchbolt-return spring which biases the latchbolt to a latch-closed position, c) a lock device, and d) first and second movement means by either of which to move the latchbolt into a latch-opened position; wherein movement of the first movement means to move the latchbolt into a latch-opened position does not disturb the second movement means; and wherein the lock device, when locked, prevents movement of the second movement means into the latch-opened position. Some of these embodiments comprise a structural element that supports the latchbolt, the latchbolt-return spring, the lock device, and the first and second movement means. In some of these embodiments, the lock device comprises a deadbolt. And in some of these embodiments, the lock device controls rotation of the second movement means.

Some embodiments of the invention provide a spring-latch assembly for latching a door closed, comprising: a) a spring-return latchbolt; b) a separate element; c) a support structure mountable to a first side of the door and supporting the latchbolt and the separate element, with the separate element situated between the latchbolt and the first side of the door; d) a first handle attached to the latchbolt and on the first side of the door, wherein motion of the first handle along a first path translates the latchbolt in a first direction relative to the support structure from a locked-door position to an opened-door position, and translates the latchbolt along the first path in a second and opposite direction to a locked-door position; e) a second handle attached to the separate element from a second side of the door that is opposite the first side of the door, wherein motion of the second handle moves the separate element along a second path; and f) a dead-bolt locking device having a dog that is movable into the second path to achieve a locked position or out of the second path to achieve an unlocked position; wherein an extension to the latchbolt lies in the second path where it can be contacted and moved to the opened-door position of the latchbolt by the separate element; wherein a portion of the separate element prevents the separate element from moving the latchbolt out of its closed-door position and into its opened-door position if the dog is in the second path; and wherein the dog cannot reach the path of the latchbolt to block motion of the latchbolt. In some of these embodiments, the first handle is a knob that rotates to translate the latchbolt. In some of these embodiments, the second handle is used for translating the separate element. And in some of these embodiments, the second handle is a key-lockable knob used for translating or rotating the separate element.

Objects and Advantages of the Invention

Embodiments of the current invention provide lockable spring-return door latches for doors that swing open and closed. These embodiments have improved functionality for doors that separate living spaces, and in particular that separate protected spaces from unprotected spaces. A primary functional advantage of embodiments of the current invention is that they provide for quick and easy exiting from a protected space by simply using a handle or knob to slide a latchbolt to its opened-door position without disturbing a locked control presented for entrance to the protected space from the unprotected space. This also means that with some embodiments of the current invention, a door latch can be locked to a closed position before or after the door is closed, and it will remain locked after the door is closed. Another advantage is that when a lockable spring-return door latch of some embodiments of the current invention is applied to a door that opens only outward into the unprotected space and with a beveled end of its latchbolt facing inward, the latchbolt can make carding from the unprotected side of the door almost as difficult as if the latchbolt were a deadbolt. One of the other advantages provided by some embodiments of the current invention is that a latchbolt mechanism (including a latchbolt subassembly and lock of the current invention) can be mounted to a surface of a door facing the protected space and can require only one to three holes through the door for passage of one or more control handles or spindles from knobs and/or keylocks facing the unprotected space. An advantage to locating a latchbolt mechanism on a side of a door facing a protected side obviously affords greater protection of that mechanism from threats posed from the unprotected space. Having the latchbolt subassembly and lock device mounted on one of the two sides of the door, rather than within the door, also makes it easy to access and maintain or replace its parts.

The various features and further advantages of the present invention(s) and its preferred embodiments will become apparent to ones skilled in the art upon examination of the accompanying drawings and the following detailed description of exemplary embodiments. It is intended that any additional advantages be incorporated herein. The contents of the following description and of the drawings are set forth as examples only and should not be understood to represent limitations upon the scope of the present invention(s).

BRIEF DESCRIPTION OF THE SEVERAL VIEWS OF THE DRAWINGS

The foregoing objects and advantages of the present invention may be more readily understood by one skilled in the art with reference being had to the following detailed description of several embodiments thereof, taken in conjunction with the accompanying drawings. Within these drawings, callouts using like reference numerals refer to like elements in the several figures (also called views) where doing so won't add confusion. A letter added to a callout numeral usually indicates the element is in some way physically different from that called out with only the same numeral. Within these drawings.

DETAILED DESCRIPTION OF THE INVENTION

Figure 1:
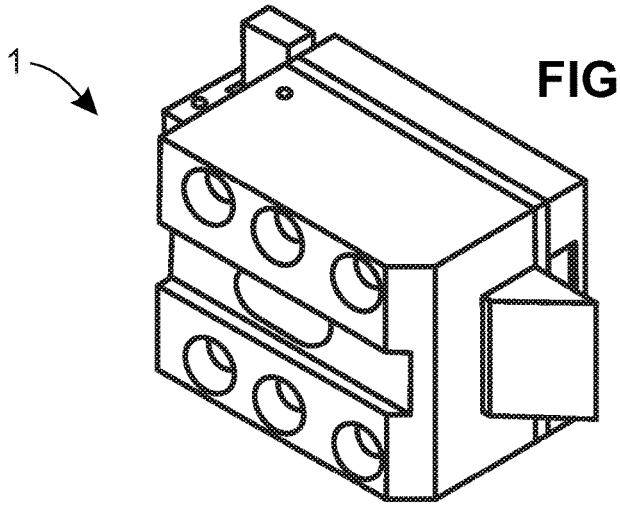
FIG. 1 shows a perspective view from the front, right, and above of an exemplary embodiment of a latchbolt subassembly.

The following is a detailed description of exemplary embodiments of the invention as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims. Within this disclosure and the claims, the term "latchbolt" is defined to mean a bolt used to hold a door closed, wherein the bolt has a beveled or angled end configured to strike a feature of a door jam (or edge of a doorway) as the door closes and thereby causing the bolt to be moved aside sufficiently for the door to close all-the-way.

FIG. 1 shows a perspective view from the front, right, and above of an exemplary embodiment of a latchbolt subassembly 1 which forms part of some exemplary embodiments of the current invention. Such a latchbolt subassembly can be mounted to an external surface of a door, with the rear surface 11S (shown in FIG. 3) of the latchbolt subassembly 1 flat against the door.

Figure 2:
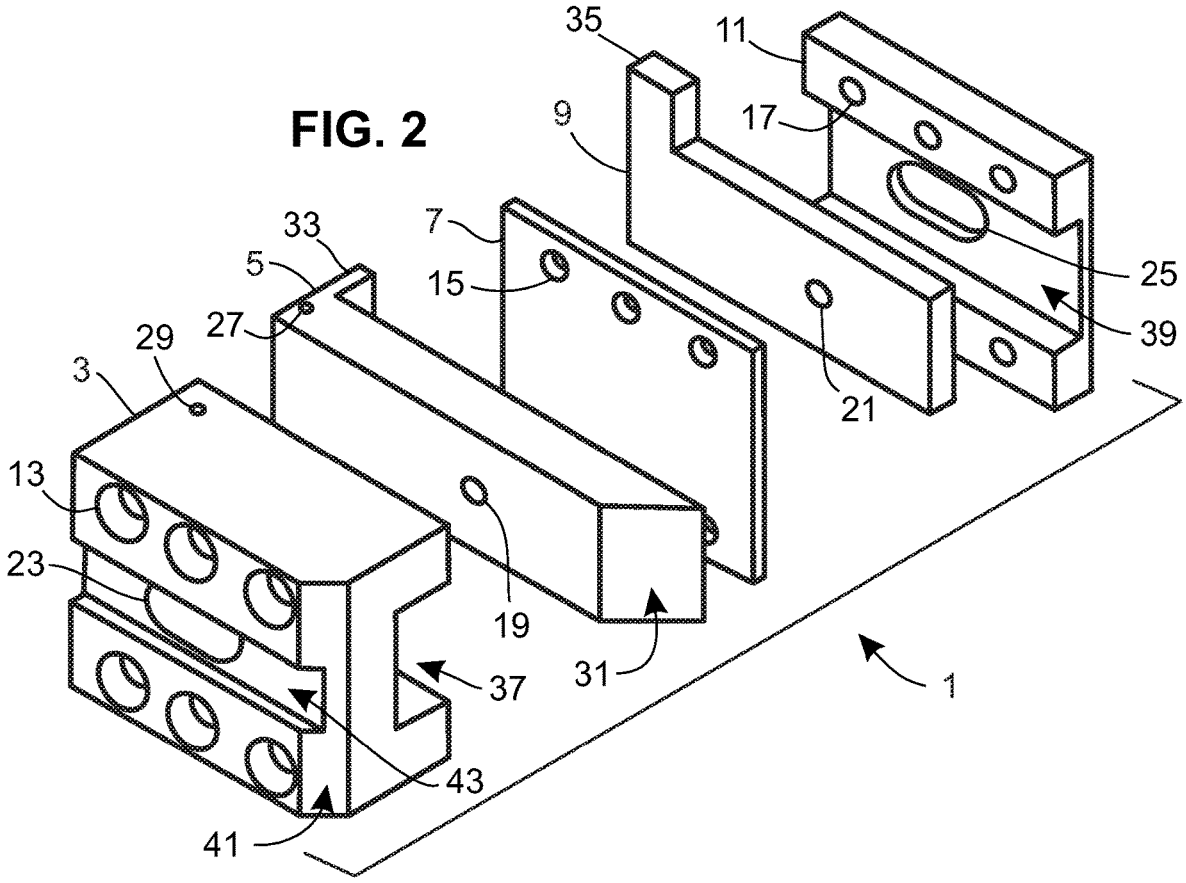
FIG. 2 shows a similar view to that of FIG. 1 of a latchbolt subassembly, but with the component parts of the subassembly moved apart to reveal more of a latchbolt and a separate element as well as otherwise hidden features.

FIG. 2 shows a similar view to that of FIG. 1 of the latchbolt subassembly 1, but with the component parts 3, 5, 7, 9, and 11 of the subassembly moved apart to reveal more of a latchbolt 5 and a separate element 9 as well as otherwise hidden features. The latchbolt 5 is a unitary element, i.e. one that is not made up of intermoving parts, and one that does not come apart in operation. A slot or channel 37 in a front supporting block 3 combined with a spacer 7 forms a space within which the latchbolt 5 can slide linearly. And a slot or channel 39 in a rear supporting block 11 combined with the spacer 7 forms a space within which a separate element 9 can slide linearly and parallel to the latchbolt 5. The latchbolt 5 has one beveled end 31 and an extension 33 at the opposite end which extends past the spacer 7 to overlap the path along which the separate element 9 can slide. The separate element 9 has an extension 5 that extends upward clear of the extension 33 on the latchbolt 5. The front supporting block 3 has two holes, one hole 29 at the top, and the other hole 29 at the bottom. The latchbolt 5 also has two holes, one 27 at the top, and the other hole 27 at the bottom. These holes 27 and 29 are for holding posts at the opposite ends of tension springs to bias the position of the latchbolt 5 into the position shown in FIG. 1. The latchbolt 5 has a hole 19 (a first movement means 19) for attaching a handle to control positioning of the latchbolt 5. Such a handle would extend through the slotted hole 23 shown in the front supporting block 3. The separate element 9 has a hole 21 (a second movement means 21) for attaching a handle to control positioning of the separate element 9. Such a handle would extend through the slotted hole 25 in the rear supporting block 11. The slotted holes 23 and 25 are shown having the same lengths, and they limit travel of the latchbolt 5 and the separate element 9 to a distance sufficient to allow the beveled end 31 of the latchbolt 5 to be moved into and out of the channels 37, i.e. from an unlatched position to a latched position. The front supporting block 3 has a beveled edge 41 to provide clearance from a door jam. The latchbolt subassembly is assembled with bolts that would run through the six holes 13 in each of the front supporting block 3 and into the six holes 17 in the rear supporting block 11. Each of the principal parts 3, 5, 7, 9, and 11 can be made of metal or plastic, and each can be 3D-printed with a material that becomes rigid and hard after or during the printing process.

Figure 3:
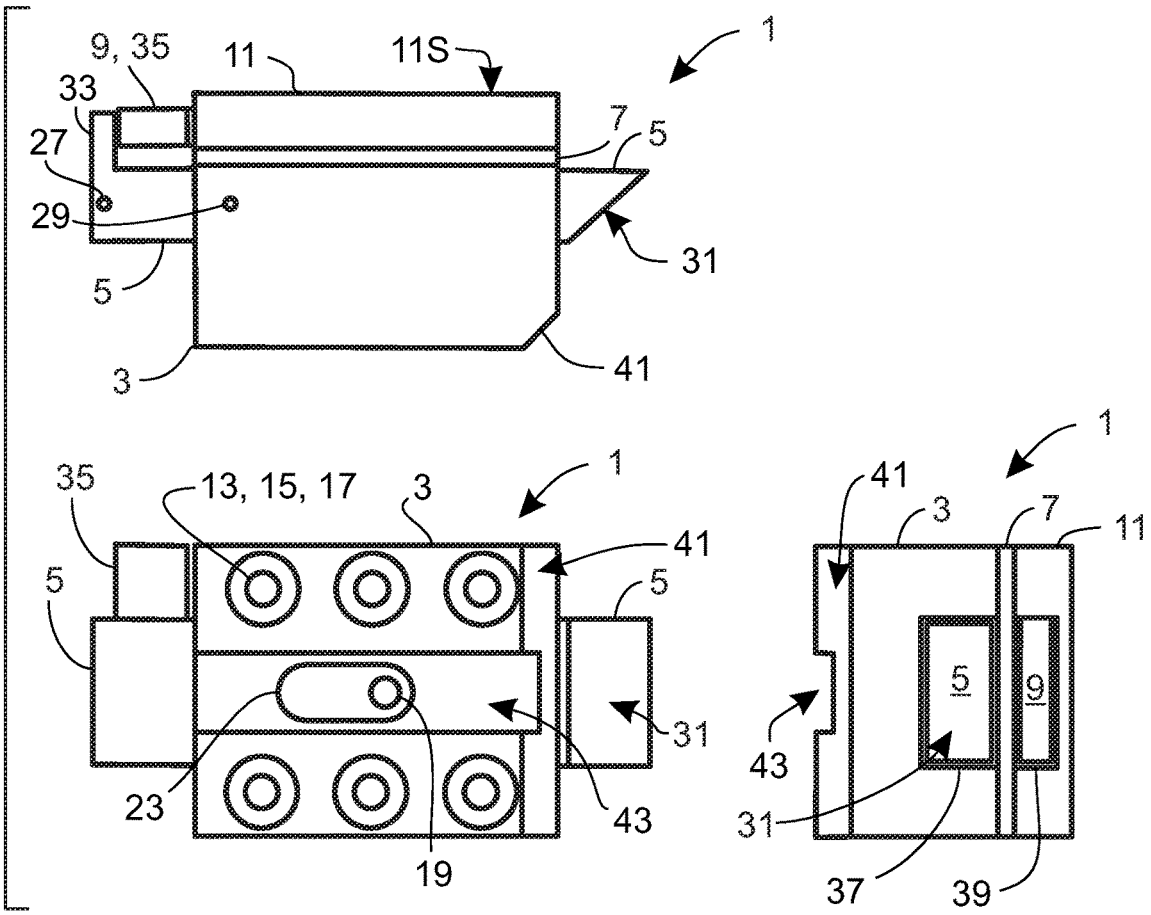
FIG. 3 shows a top view (upper left of figure), a front view (lower left of figure), and an end view from the right (lower right of figure) of the latchbolt subassembly shown in FIG. 1.

FIG. 3 shows a top view (upper left of figure), a front view (lower left of figure), and an end view from the right (lower right of figure) of the latchbolt subassembly 1 shown in FIGS. 1 and 2. The latchbolt 5 is shown in the extended or latched position with the separate element 9 trapped between the extension 33 of the latchbolt 5 and the rear supporting block 11. The separate element 9, in that position, can be said to be in its rest position, a position that correlates with the latchbolt 5 being in the latched position.

Figure 4:
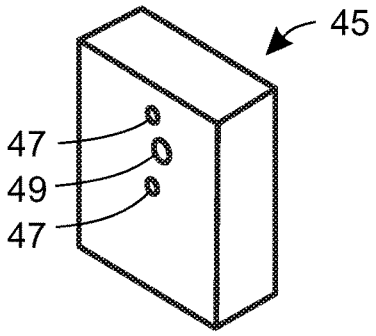
FIG. 4 shows a perspective view from the front, right, and above of an exemplary embodiment of a lock device with its bolt retracted.

FIG. 4 shows a perspective view from the front, right, and above of an exemplary embodiment of a lock device 45 having a rectangular enclosure that can be mounted with its rear surface flat against the same surface of a door to which the above latchbolt subassembly 1 can be mounted. A latchbolt, deadbolt, or other dog element can be extended from the bottom of the enclosure, but in this view it is not extended and therefore not in view. The clearance hole 49 is for a spindle to reach a tubular lock subassembly within the enclosure.

Figure 5:
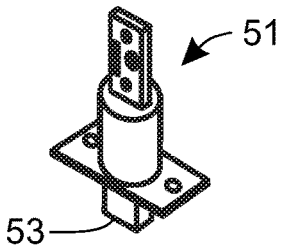
FIG. 5 shows a perspective view from the front, right, and above of a tubular lock subassembly.

FIG. 5 shows a perspective view from the front, right, and above of a tubular lock subassembly 51 that can be found within the lock device 45. This view shows its bolt or dog in an extended position as it would be when used to lock a separate element 9 in place from moving against an extension 33 of a latchbolt 5 to move the latchbolt 5 into an opened-door position. Such a tubular lock subassembly 51 can preferably be a standard tubular deadbolt subassembly which would use the holes 47 shown in FIG. 4 for its mounting within the lock device 45.

Figure 6:
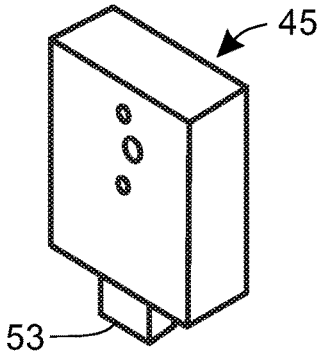
FIG. 6 shows a perspective view from the front, right, and above of the lock device shown in FIG. 4 but with its bolt extended.

FIG. 6 shows a perspective view from the front, right, and above of the lock device 45 shown in FIG. 4 but with its bolt 53 in an extended position.

Figure 7:
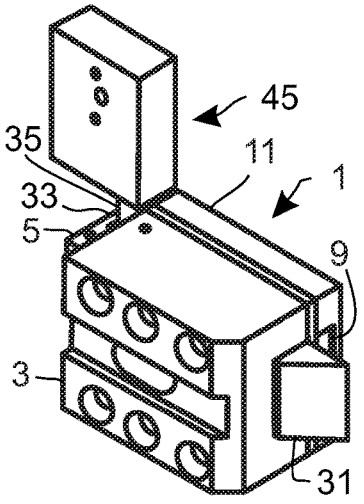
FIG. 7 shows a perspective view from the front, right, and above of an exemplary embodiment of a latchbolt mechanism that includes both the latchbolt subassembly shown in FIG. 1 and the lock device shown in FIG. 4, and showing the mechanism in a not-locked and not-opened position.

FIG. 7 shows a perspective view from the front, right, and above of an exemplary embodiment of a latchbolt mechanism that includes both the latchbolt subassembly 1 shown in FIGS. 1-3 and the lock device 45 shown in FIG. 4, and showing the latchbolt mechanism in a not-locked and not-opened position, i.e. in a latched and unlocked state. Note that a dog 53 (shown in FIGS. 5 and 6) is not visible, and therefore not extended from the bottom of the lock device 45, and that the latchbolt 5 is positioned in its rightmost position, a latched or closed-door position that extends its beveled surface 31 to the right of the front support block 3. Note also that the separate element 9 is positioned as far right as it can be, showing an end at the rightmost end of the channel 39.

Figure 8:
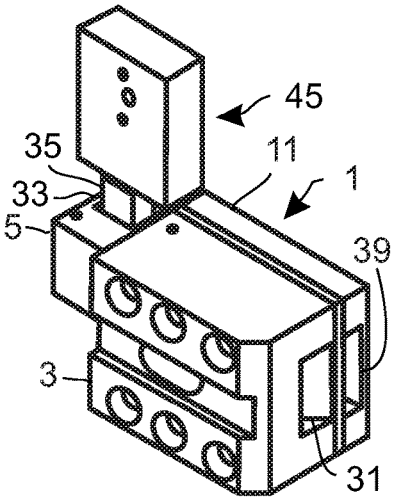
FIG. 8 shows a view similar to that shown in FIG. 7 of a latchbolt mechanism but showing the mechanism in a not-locked and opened-from-outside position.
Figure 12:
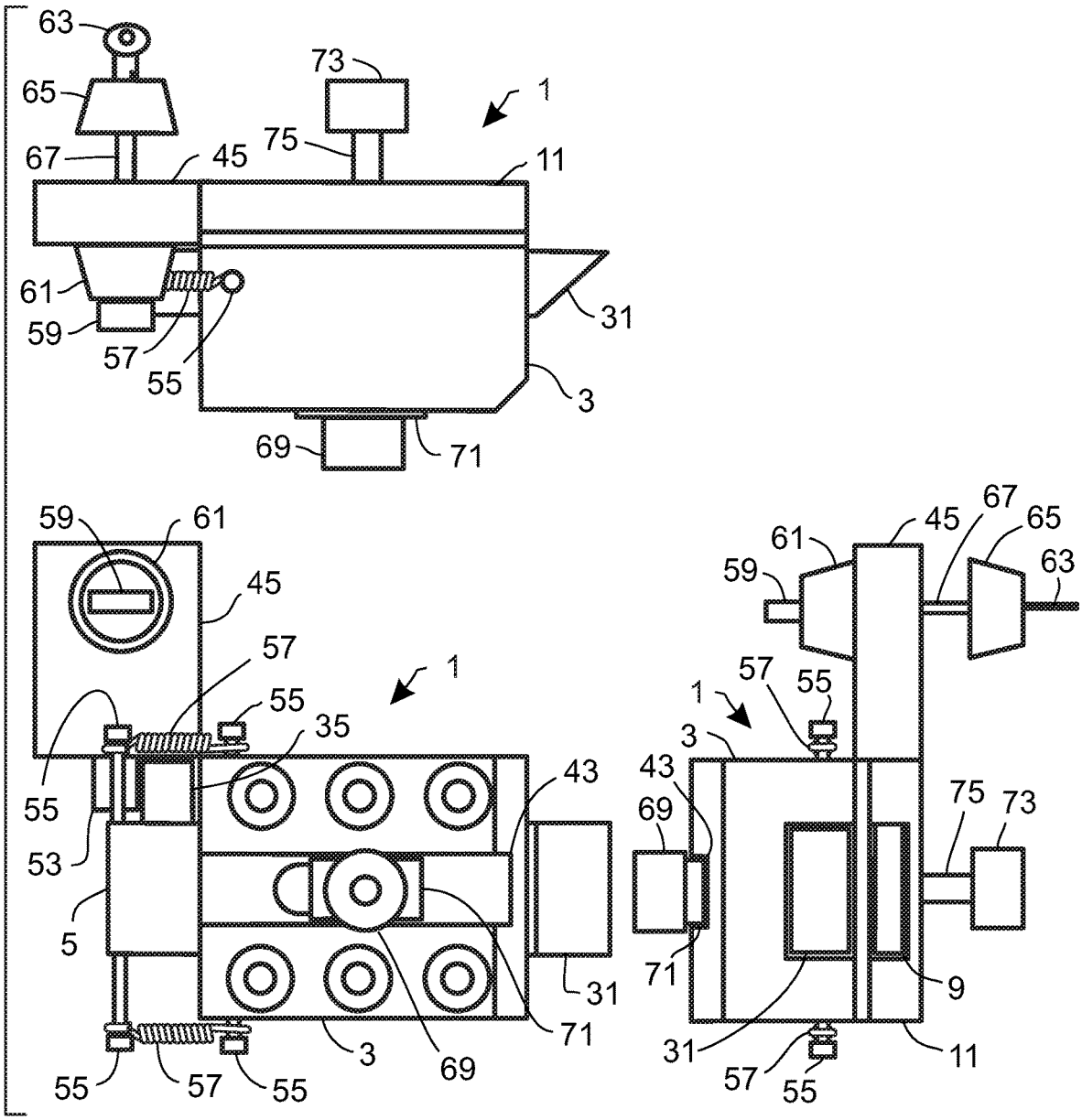
FIG. 12 shows views similar to FIG. 3 but of an exemplary embodiment of a latchbolt subassembly along with the lock device shown in FIGS. 4 and 6, lock furniture, latchbolt furniture, separate element furniture, and latchbolt-biasing springs.

FIG. 8 shows a view similar to that shown in FIG. 7 of a latchbolt mechanism but showing the mechanism in a not-locked and opened-from-outside position, i.e. unlatched by the separate element 9 having pushed the latchbolt 5 to its unlatched position. Note that a dog 53 (shown in FIGS. 5 and 6) is not visible, and therefore not extended from the bottom of the lock device 45, and that the latchbolt 5 is positioned to the left and into an opened-door or unlatched position that retracts its beveled surface 31 into the front support block 3 to where its beveled end 31 can barely be seen. Note also that the separate element 9 is positioned to the left also, positioning its right end fully within the channel 39 making it not visible in this view. And note in this figure, that if the latchbolt 5 were to be biased by a spring toward the latched position (as shown in FIG. 12), the separate element 9 would have had to push it to that position, as the latchbolt 5 has no way to pull on the separate element 9.

Figure 9:
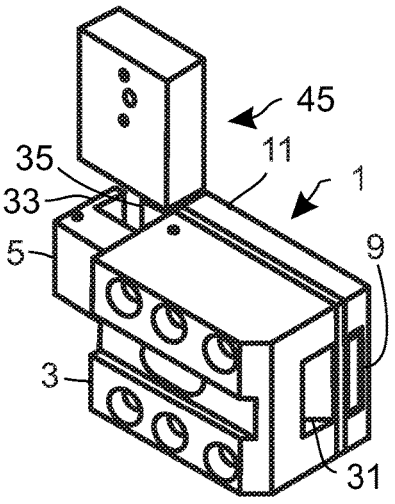
FIG. 9 shows a view similar to that shown in FIG. 7 of a latchbolt mechanism but showing the mechanism in a not-locked and opened-from-inside position.

FIG. 9 shows a view similar to that shown in FIG. 7 of a latchbolt mechanism but showing the mechanism in a not-locked and opened-from-inside position. Note that a dog 53 (shown in FIGS. 5 and 6) is not visible, and therefore not extended from the bottom of the lock device 45, and that the latchbolt 5 is positioned to the left and into an opened-door position (the unlatched position) that retracts its beveled surface 31 into the front support block 3. Note also that the separate element 9 is positioned as far right as it can be, showing an end at the rightmost end of the channel 39.

Figure 10:
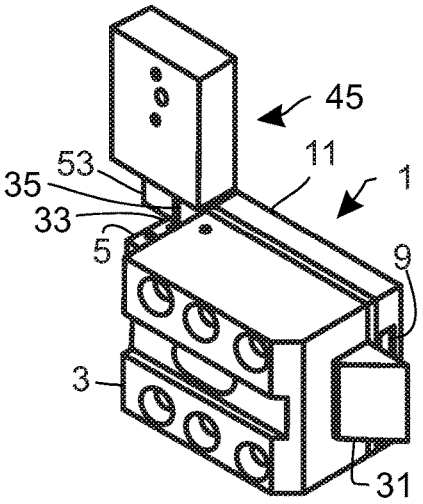
FIG. 10 shows a view similar to that shown in FIG. 7 of a latchbolt mechanism but showing the mechanism in a locked and not-opened position.

FIG. 10 shows a view similar to that shown in FIG. 7 of a latchbolt mechanism but showing the mechanism in a locked and not-opened position. Note that a dog 53 (shown in FIGS. 5 and 6) is visible, and therefore is extended from the bottom of the lock device 45, and that the latchbolt 5 is positioned in its rightmost position, a closed-door position (its latched position) that extends its beveled surface 31 to the right of the front support block 3. Note also that the separate element 9 is positioned as far right (its rest position) as it can be, showing an end at the rightmost end of the channel 39.

Figure 11:
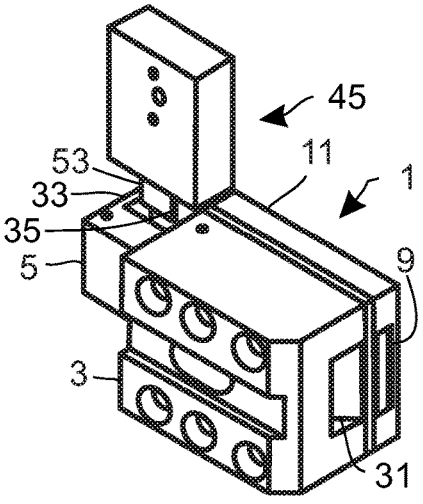
FIG. 11 shows a view similar to that shown in FIG. 7 of a latchbolt mechanism but showing the mechanism in a locked and opened-from-inside position.

FIG. 11 shows a view similar to that shown in FIG. 7 of a latchbolt mechanism but showing the mechanism in a locked and opened-from-inside position. Note that a dog 53 (shown in FIGS. 5 and 6) is visible, and therefore is extended from the bottom of the lock device 45, and that the latchbolt 5 is positioned to the left and into an opened-door position (its unlatched position) that retracts its beveled surface 31 into the front support block 3. Note also that the separate element 9 is positioned as far right as it can be, showing an end at the rightmost end of the channel 39, so it is kept in its rest position by the dog 53.

FIG. 12 shows views similar to FIGS. 3 and 10 but of an exemplary embodiment of a latchbolt subassembly 1 along with the lock device 45 shown in FIGS. 4 and 6, handle and lock furniture 59, 61, 63, 65, 67, 69, 71, 73, and 75, as well as latchbolt biasing springs 57 and their support posts 55. The furniture includes a thumb-turn knob 59 and cover 61 at the front of the lock device 45 (for locking the lock device 45 without a key from the front); a key 63 for a cylindrical tumbler lock with cover 65 and a key lock spindle 67 at the rear of the lock device 45 (for locking the lock device 45 from the rear with a key); a handle 69 and handle-guide 71 at the front of the front support block 3 (which is attached to the hole 19 in the latchbolt 5 visible in FIG. 2 enabling the latchbolt 5 to be manipulated from the front of the front support block 3); a handle 73 and shaft 75 at the rear of the rear support block 11 (which is attached to the hole 21 in the separate element 9 visible in FIG. 2, enabling the separate element 9 to be manipulated from the rear of the rear support block 11). The spring-supporting posts 55, in the front support block 3 and in the latchbolt 5, bias the latchbolt to the right-hand side of the latchbolt subassembly 1. Several limitations to motions between the latchbolt 5, the separate element 9 and their supporting structure of elements 3,7, and 11 can be understood by the arrangement of parts in this figure: a) moving the latchbolt 5 toward the latched position can resist movement of the separate element 9 away from the rest position of the separate element 9; b) moving the latchbolt 5 to the latched position moves the separate element 9 to the rest position of the separate element 9; c) moving the latchbolt 5 over a distance necessary to reach the unlatched position from the latched position does not by itself move the separate element 9 away from the rest position of the separate element 9, which is to say that the latchbolt 5 does not pull the separate element 9 from the rest position of the separate element 9 and therefore that the separate element 9 does not resist movement of the latchbolt 5 from its latched position to its unlatched position.

Figure 13:
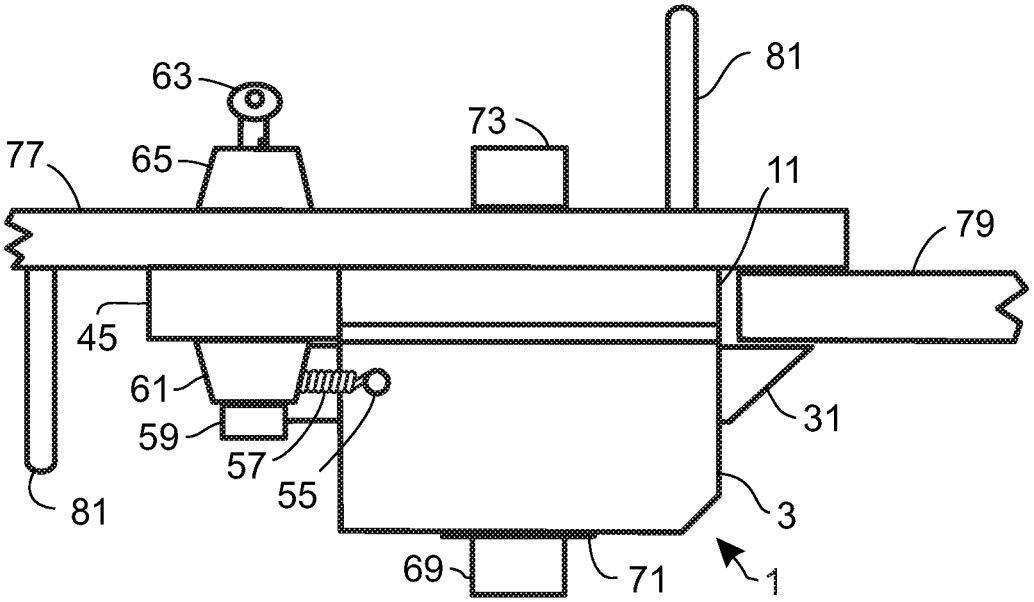
FIG. 13 shows a top view of the latchbolt subassembly that is shown in the upper left of FIG. 12 but mounted to a door and latched closed on a wall or door casing.

FIG. 13 shows a top view of the same items shown in the upper left of FIG. 12 but mounted to a door 77 and latched in a closed-door position onto a wall or door casing 79. Door handles 81 are shown on the door 77 both on the front and rear of the door. The wall or door casing 79 serves here as a door stop. The latchbolt subassembly 1 and lock device 45 are mounted to the front side/surface of the door 77. Note that with the beveled end 31 of the latchbolt 5 oriented with the bevel facing generally upward in this view, the door 77 is to swing open upward in this view.

Figure 14:
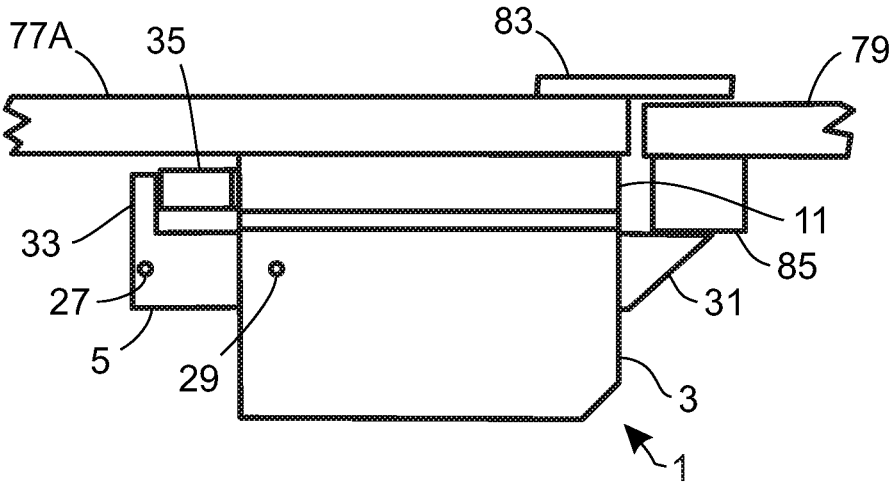
FIG. 14 shows a top view of just the latchbolt subassembly that is shown in the upper left of FIG. 3 but mounted to a door and latched closed on a first embodiment of a wall or door casing.

FIG. 14 shows a top view of just the latchbolt subassembly 1 that is shown in the upper left of FIG. 3 but mounted to a door 77A and latched closed onto a wall or door casing 79 configured differently than shown in FIG. 13. In this configuration, the door 77A is fitted with some overhanging trim 83 that stops the door at the wall or door casing 79 serving as a door stop. An element 85 is added to the wall or door casing 79 to provide for a close fit in the closed positions of the door 77A and latchbolt 5. As in the door and wall configuration in FIG. 13, the door 77A is to swing open upward in this view.

Figure 15:
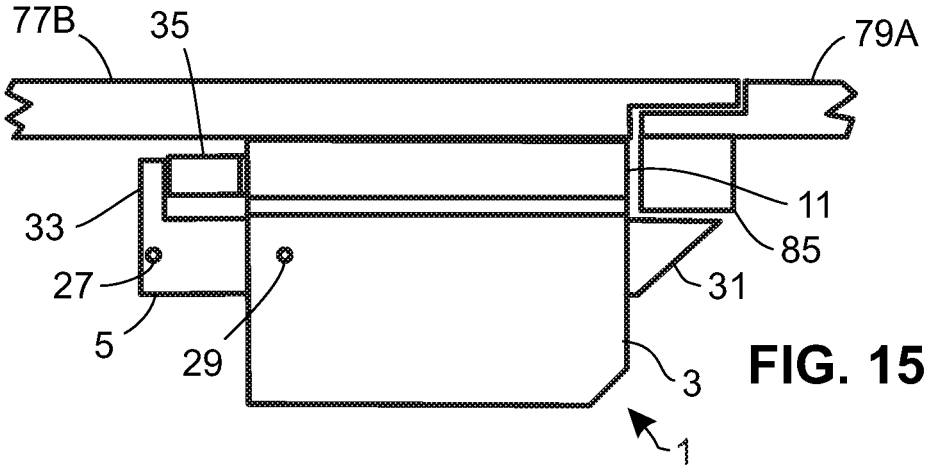
FIG. 15 shows a top view of just the latchbolt subassembly that is shown in the upper left of FIG. 3 but mounted to a door and latched closed on a second embodiment of a wall or door casing.

FIG. 15 shows a top view of just the latchbolt subassembly 1 that is shown in the upper left of FIG. 3 but mounted to a door 77B and latched closed on a wall or door casing 79A. Both the door 77B and the wall or door casing 79A are mitered to fit one-another with the wall 79A serving as a door stop. As in the configuration shown in FIG. 14, an element 85 is added to the wall or door casing 79 to provide for a close fit in the closed positions of the door 77B and latchbolt 5. As in the door and wall configuration in FIGS. 13 and 14, the door 77B is to swing open upward in this view.

Figure 16:
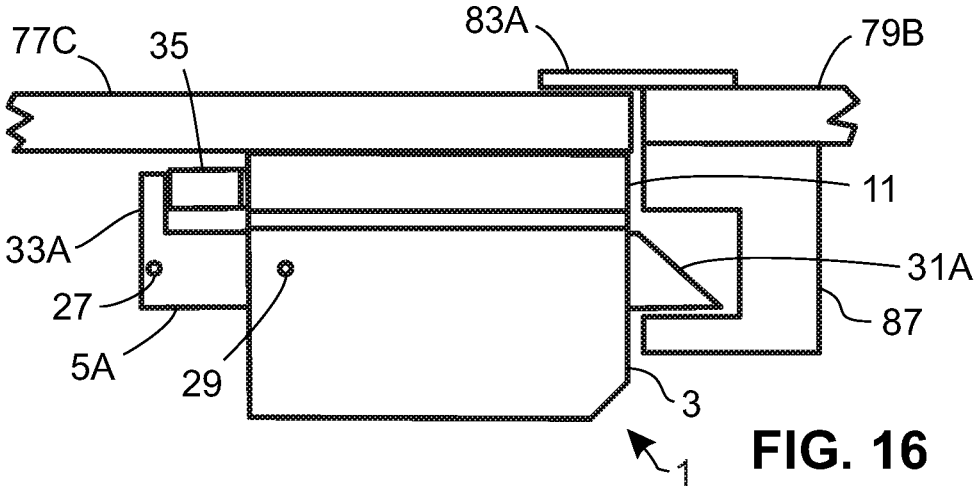
FIG. 16 shows a top view of just the latchbolt subassembly that is shown in the upper left of FIG. 3 but mounted to a door and latched closed on a third embodiment of a wall or door casing, and with a beveled end of its latchbolt facing in the opposite direction to that shown in the previous figures.

FIG. 16 shows a top view of just the latchbolt subassembly 1 that is shown in the upper left of FIG. 3, with a reversal of the direction the beveled end 31 of the latchbolt 5A is facing (relative to latchbolt 5), and mounted to a door 77C and latched closed on a wall or door casing 79B. In contrast to the mounting of trim 83 to the door 77A shown in FIG. 14, trim 83A is instead mounted to the wall or door casing 79B. A keeper pocket 87 is also added to the wall or door casing 79B. Contrary to what was shown in FIGS. 13-15, the door 77C is to swing downward in this view.

Figure 17:
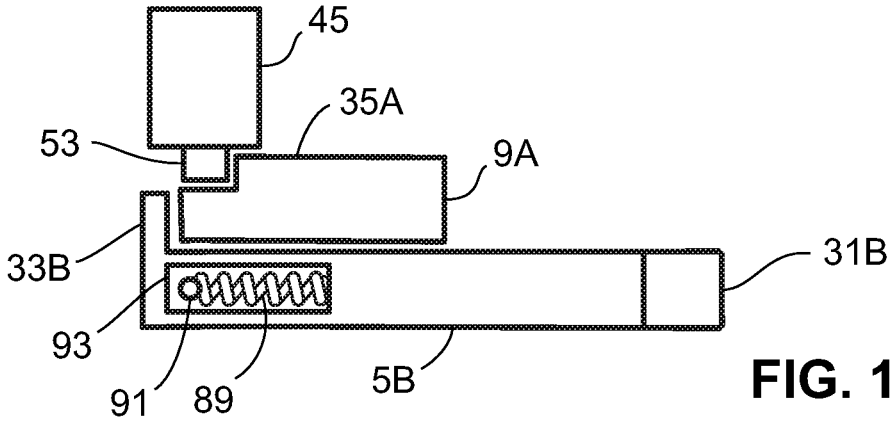
FIG. 17 shows a front view of an exemplary but different embodiment of two key components of a latchbolt subassembly (a latchbolt and a separate element) along with the locking device shown in FIG. 6.

FIG. 17 shows a front view of an exemplary but different embodiment of two key components of a latchbolt subassembly (a latchbolt 5B and a separate element 9A) along with the locking device 45 shown in FIG. 6. The shapes and features of the latchbolt 5B and separate element 9A can be used in some exemplary embodiments of the current invention. The latchbolt extension 33B extends in a direction perpendicular to the direction that extensions 33 and 33A extended from the latchbolts 5 and 5A described above; that is, extension 33B extends upward whereas extensions 33 and 33A extended rearward. Compatibly with this different direction of extension of extension 33B, the separate element 9A having an extension 35A can be of the different shape shown. As someone from the rear attempts to open the latch by moving the separate element 9A, to the left in this view, these different shapes cause the separate element 9A to push either against the dog 53, if the dog 53 is extended downward from the lock device 45 (as shown), or to push against the extension 33B of the latchbolt 5B. Note that an alternative configuration is shown for the use of a spring 89 to provide spring-return force to the latchbolt 5B. The spring is a compression spring mounted between a non-moving support post 91 and a inside surface of a slotted hole 93 made in the latchbolt 5B.

Figure 18:
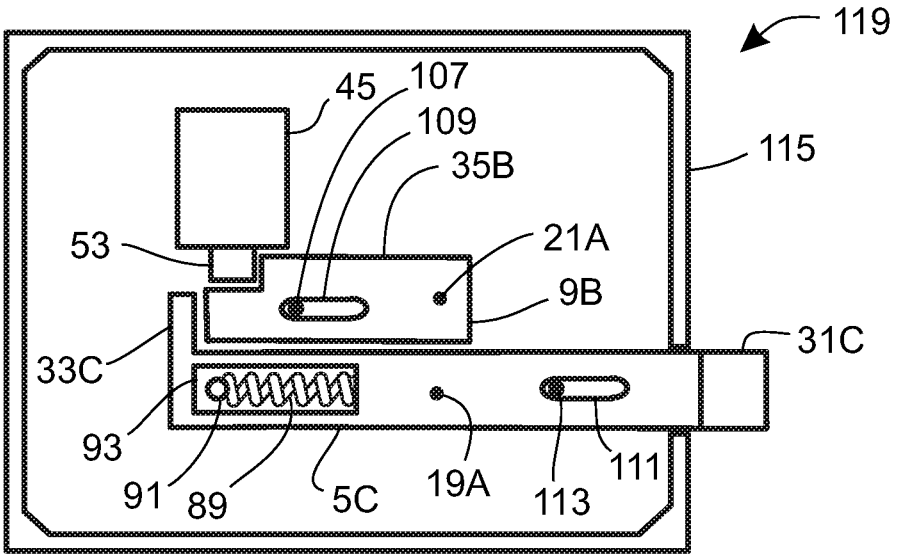
FIG. 18 shows a front view of an exemplary embodiment of a latchbolt mechanism having parts similar to those shown in FIG. 17, but with the addition of a mounting structure and with additional features added to the two key components.

FIG. 18 shows a front view of an exemplary embodiment of a latchbolt mechanism, latchbolt mechanism 119, having parts similar to those shown in FIG. 17, but with the addition of a mounting structure 115 and with additional features added to a latchbolt 5C (with an extension 33C) and to a separate element 9B. No additional features are shown for the lock device 45 and its dog 53. The structure 115 includes guide pins 107 and 113, and a clearance slot in its perimeter wall for the beveled end of the latchbolt 5C. The additional features of the latchbolt 5C include a slotted hole 111 to restrain movement of the latchbolt 5C about the guide pin 113, and a hole 19A as a first movement means by which to attach a handle to the latchbolt 5C and move the latchbolt 5C. The additional features of the separate element 9B (i.e. the second movement means 9B) include a slotted hole 109 to restrain movement of the separate element 9B about the guide pin 107, and a hole 21A by which to attach a handle to the separate element 9B and move the separate element 9B.

Figure 19:
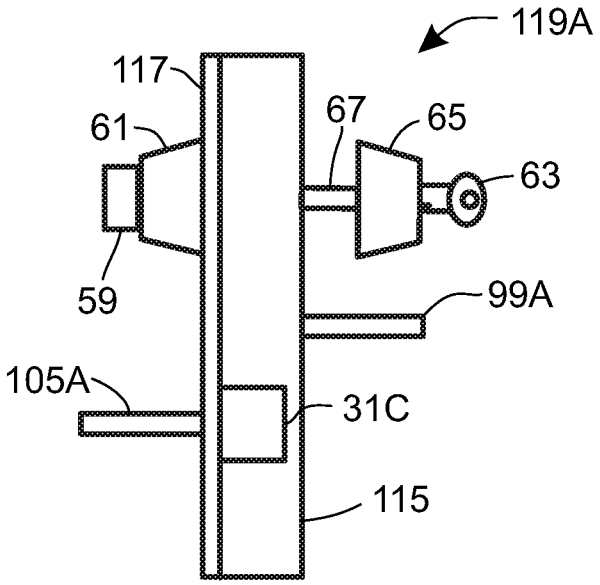
FIG. 19 shows a right end view of the latchbolt mechanism shown in FIG. 18 but with the addition of a cover, latchbolt activating handles, and furniture to the lock device.

FIG. 19 shows a right end view of a latchbolt mechanism 119A modified from the latchbolt mechanism 119 shown in FIG. 18. The modifications are the addition of a cover 117, a handle 105A for moving/sliding the latchbolt 5C, a handle 99A for moving/sliding the separate element 9B, and furniture to the lock device 45. The furniture to the lock device 45 includes a thumb-turn knob 59 and cover 61 at the front of the lock device 45 (for locking the lock device 45 without a key from the front); a key 63 for a cylindrical tumbler lock with cover 65 and a key lock spindle 67 both at the rear of the lock device 45 (for locking the lock device 45 from the rear with a key).

Figure 20:
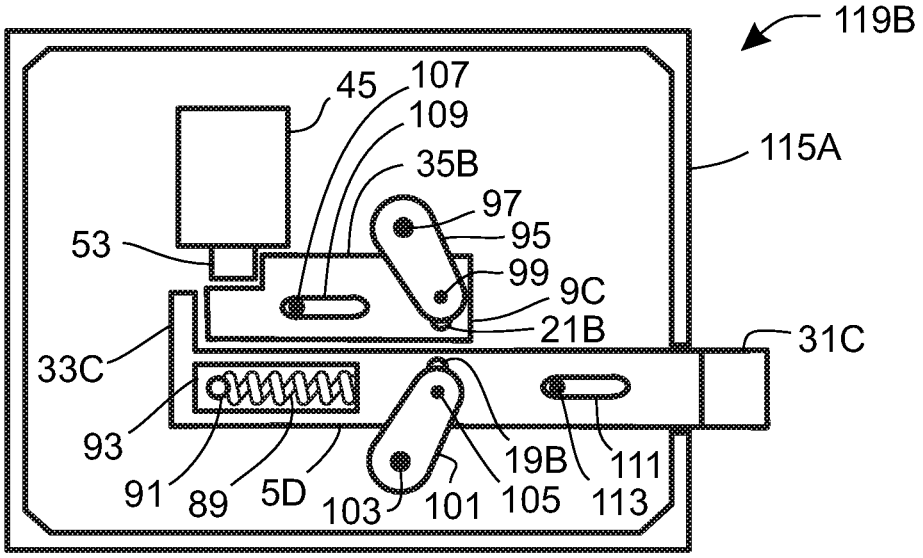
FIG. 20 shows a front view similar to FIG. 18 but with cams added to enable rotational controls of the latchbolt and of the separate element rather than handles for translating them.

FIG. 20 shows a front view of another exemplary embodiment of a latchbolt mechanism, latchbolt mechanism 119B, similar to that shown in FIG. 18 but with cams 95 and 101 (also called swing arms) added to enable rotational controls of the separate element 9C and latchbolt 5D respectively, rather than the translatable handles 99A and 105A shown in FIG. 18. The support structure 115A has pass-through holes (not shown) for passage of a shaft or spindle 103 coupled to the cam 101 that drives the latchbolt, and passage of a shaft or spindle 97 coupled to the cam 95 that drives the separate element 9C. The cam 101 has a drive pin 105 that protrudes into a slotted hole 19B for moving the latchbolt 5D left and right in this view. The cam 95 has a drive pin 99 that protrudes into a slotted hole 21B for moving the separate element 9C left and right in this view.

Figure 21:
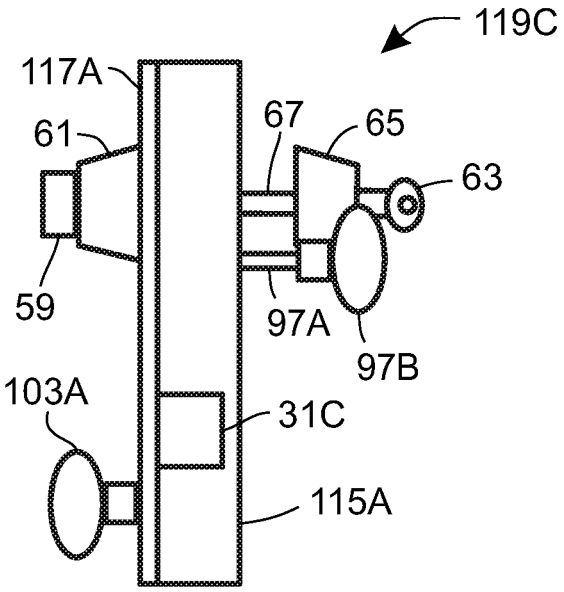
FIG. 21 shows a right end view of the latchbolt mechanism shown in FIG. 20 but with the addition of a cover, latchbolt activating knobs, and furniture to the lock device.

FIG. 21 shows a right end view of a latchbolt mechanism 119C which includes the latchbolt mechanism 119B shown in FIG. 20 but with the addition of a cover 117A, a rotational knob 103A for moving/sliding the latchbolt 5D, a rotational knob 97B with spindle 97A for moving/sliding the separate element 9C, and furniture to the lock device 45. The furniture to the lock device 45 includes a thumb-turn knob 59 and cover 61 at the front of the lock device 45 (for locking the lock device 45 without a key from the front); a key 63 for a cylindrical tumbler lock with cover 65 and a key lock spindle 67 both at the rear of the lock device 45 (for locking the lock device 45 from the rear with a key).

Figure 22:
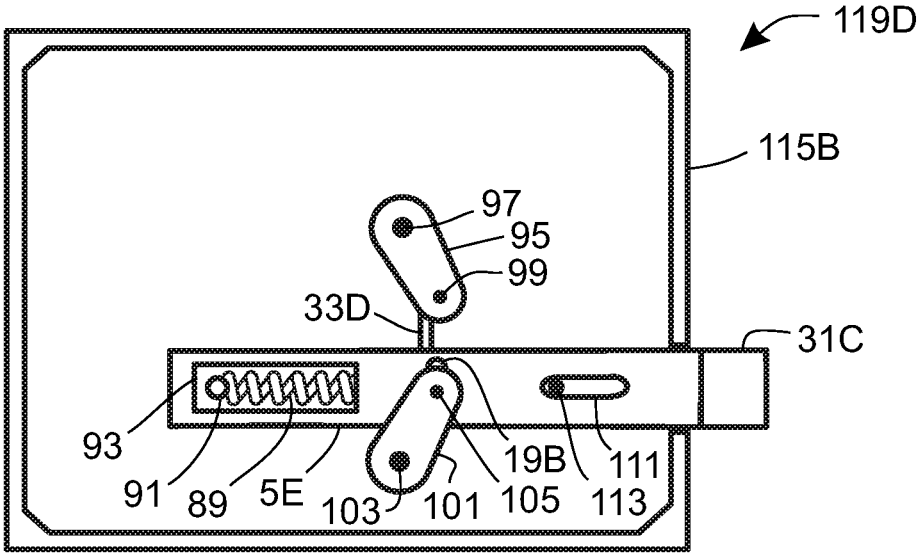
FIG. 22 shows a front view of another exemplary embodiment of a latchbolt mechanism having parts similar to those shown in FIG. 20 but without the lock device and separate element that have been previously shown, and showing instead a vertical pin attached to the latchbolt.

FIG. 22 shows a front view of another exemplary embodiment of a latchbolt mechanism, latchbolt mechanism 119D, having parts similar to those shown in FIG. 20 but not having the lock device 45 (and its dog 53), the guide pin 107, or the separate element 9C. And the latchbolt 5E is not the same as latchbolt 5D, since latchbolt 5E has a pin for an extension 33D instead of the extension 33C shown on latchbolt 5D in FIG. 20. In this manner, the cam 95 with its drive pin 99 can drive the latchbolt 5E directly without an intermediate separate element between them.

Figure 23:
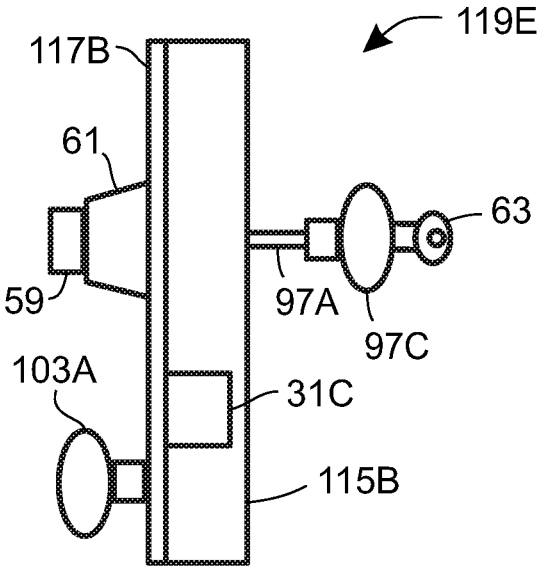
FIG. 23 shows a right end view of the latchbolt mechanism shown in FIG. 22 but with the addition of a cover, latchbolt control knobs and/or thumbturns, and a key-lock device built into the knob that is shown on the right and with which to lockout opening of the latchbolt from the right-hand side in this view.

FIG. 23 shows a right end view of a latchbolt mechanism 119E which includes the latchbolt mechanism 119D shown in FIG. 22 but with the addition of a cover 117B, a latchbolt activating knob 97C and/or thumbturn 59 (with cover 61), and a key-lock device (e.g. a tubular tumbler lock) built into the knob 97C that is shown on the right and with which to lockout opening of the latchbolt 5E from the right-hand side in this view.

Although specific embodiments of the invention have been illustrated and described herein, those of ordinary skill in the art will appreciate that any arrangement configured to achieve the same purpose may be substituted for the specific embodiments shown. This disclosure is intended to cover any and all adaptations or variations of various embodiments of the invention. It is to be understood that the above description has been made in an illustrative fashion, and not a restrictive one. For example, elements and their features in the embodiments can be of alternative shapes, locations, sizes, and complexities. One skilled in the art can also readily understand how to include additional features to provide additional functions. The scope of various embodiments of the invention includes any other applications in which the above structures and methods are used.

We claim:

1. A door-latch mechanism comprising:

a. a latchbolt that is a unitary element that moves between a first position, which is a latched position, and a second position, which is an unlatched position;

b. a separate element—that is not itself another latchbolt but is separate from the latchbolt, and that moves between a third position, where it is always situated when the latchbolt is in the first position, and a fourth position, which it assumes while holding the latchbolt at the second position;

c. a structure that supports at least the latchbolt and the separate element;

d. a latchbolt handle attached to the latchbolt; and e. a spring that acts between the structure and the latchbolt to bias both the latchbolt and the separate element to the first and third positions respectively;

wherein the latchbolt can resist movement of the separate element toward the fourth position;

and wherein the latchbolt handle is used to move the latchbolt from the first position without disturbing the separate element.

2. The door-latch mechanism of claim 1, wherein the latchbolt can move the separate element to the third position but not toward the fourth position.

3. The door-latch mechanism of claim 1, wherein the separate element is manipulable to directly contact and move the latchbolt from the first position to the second position.

4. The door-latch mechanism of claim 1, wherein the latchbolt is manipulable to move it from the first position to the second position without disturbing the separate element.

5. The door-latch mechanism of claim 1, further comprising a locking means; wherein the locking means can prevent the separate element from moving away from the third position but does not prevent movement of the latchbolt.

6. The door-latch mechanism of claim 5, wherein the structure is mounted to an outside surface of a door, and the locking means is mounted to the door and not to the structure.

7. The door-latch mechanism of claim 1, wherein the latchbolt and the separate element are both mounted on the same side of a door with the separate element situated between the latchbolt and the door.

8. The door-latch mechanism of claim 1, wherein the latchbolt handle is attached directly to the latchbolt for moving the latchbolt manually between the first position and the second position.

9. The door-latch mechanism of claim 8, wherein the latchbolt moves along a linear path.

10. The door-latch mechanism of claim 1, wherein a second handle is attached to the separate element for moving the separate element manually between the third position and the fourth position.

11. The door-latch mechanism of claim 10, wherein the separate element moves along a linear path.

12. The door-latch mechanism of claim 1, wherein the latchbolt and the separate element move parallel to one-another.

13. A door-latch mechanism comprising:

a. a unitary latchbolt constrained by a supporting structure to move linearly and only between a latched position and an unlatched position;

b. a separate element that is separate from the latchbolt and is constrained by the supporting structure to move only between a first position and a second position, wherein the separate element is at the first position whenever the latchbolt is in the latched position; and c. a separate element movement means to move the separate element and therewith to move the latchbolt into the unlatched position;

wherein movement of the latchbolt can move the separate element toward the first position but not away from the first position, and wherein the door-latch mechanism is mounted to an exterior surface of a door, and all substantial movements of the separate element are parallel to that door surface.

14. The door-latch mechanism of claim 13 wherein the separate element movement means can move the latchbolt a first distance from its latched position to its unlatched position by causing the separate element to contact and move the latchbolt as the separate element moves out of the first position a second distance equal to the first distance.

15. The door-latch mechanism of claim 13, wherein movement of the latchbolt into the latched position returns the separate element to the first position whenever the separate element is not already in the first position.

16. The door-latch mechanism of claim 13, further comprising a spring which biases the latchbolt to the latched position.

17. The door-latch mechanism of claim 16, wherein movement of the latchbolt toward the latched position can resist movement of the separate element away from the first position.

18. The door-latch mechanism of claim 13, further comprising a lock device that when locked blocks movement of the separate element out of the first position; wherein the lock device can prevent movement of the separate element but not the latchbolt.

19. A spring-latch assembly for latching a door closed, comprising:

a. a spring-return latchbolt movable by a first control means controlled from a first side of a door;

b. a separate element movable by a second control means controlled from a second side of the door opposite the first side;

c. a support structure mounted external to a door surface on the first side of the door and supporting the latchbolt and the separate element, with the separate element situated between the latchbolt and the first side of the door;

wherein a first motion of the latchbolt in a first direction translates the latchbolt from a latched position to an unlatched position, and a second motion of the latchbolt in a second and opposite direction translates the latchbolt from the unlatched position to the latched position;

wherein a third motion of the separate element in the first direction translates the separate element from a first position to a second position, and a fourth motion of the separate element in the second direction translates the separate element from the second position to the first position;

wherein movement of the latchbolt to the latched position moves the separate element to the first position, but movement of the latchbolt using the first control means over a distance necessary to reach the unlatched position from the latched position does not necessarily move the separate element to the second position; and wherein the latchbolt resists movement of the separate element over that distance to the second position.

20. The spring-latch assembly of claim 19, further comprising: a locking device having a dog that is movable into a path of at least a first portion of the separate element to achieve a locked position of the separate element at the third position without preventing motion of the latchbolt between its latched and unlatched positions; wherein the separate element contacts the latchbolt while moving to the second position to move all of the latchbolt to the unlatched position.

* * * * *